United States Patent [19]
Ichiyama et al.
[11] 4,293,350
[45] Oct. 6, 1981

[54] GRAIN-ORIENTED ELECTROMAGNETIC STEEL SHEET WITH IMPROVED WATT LOSS

[75] Inventors: Tadashi Ichiyama, Sagamihara; Shigehiro Yamaguchi, Fujisawa; Tohru Iuchi, Kawasaki; Katsuro Kuroki, Kitakyushu, all of Japan

[73] Assignee: Nippon Steel Corporation, Tokyo, Japan

[21] Appl. No.: 58,757

[22] Filed: Jul. 19, 1979

[30] Foreign Application Priority Data

Jul. 26, 1978 [JP] Japan ..... 53-91217

[51] Int. Cl.[3] ..... H01F 1/04
[52] U.S. Cl. ..... 148/111; 148/9.5; 148/120
[58] Field of Search ..... 148/110-113, 148/120, 9.5

[56] References Cited

U.S. PATENT DOCUMENTS

| | | | |
|---|---|---|---|
| 3,192,078 | 6/1965 | Gordon et al. | 148/121 |
| 3,647,575 | 3/1972 | Fiedler et al. | 148/121 |
| 3,856,568 | 12/1974 | Tanaka et al. | 148/12 A |
| 3,990,923 | 11/1976 | Takashina et al. | 148/112 |
| 4,063,063 | 12/1977 | Funck et al. | 148/9.5 |

*Primary Examiner*—Aaron Weisstuch
*Assistant Examiner*—John P. Sheehan
*Attorney, Agent, or Firm*—Kenyon & Kenyon

[57] ABSTRACT

In a method of producing a grain-oriented electromagnetic steel sheet, a laser beam is irradiated onto the steel sheet, which has been subjected to a final high temperature annealing in order to approximate the crystal orientation of the sheet in a (110), [001] orientation. Because of the laser beam irradiation, regions of high dislocation density are locally formed in the steel sheet and subdivide the magnetic domains, with the result that a low watt loss is achieved.

15 Claims, 9 Drawing Figures

2mm

GRAIN-ORIENTED ELECTROMAGNETIC STEEL SHEET WITH IMPROVED WATT LOSS

BACKGROUND OF THE INVENTION

The present invention relates to a method of producing a sheet of grain-oriented electromagnetic steel, particularly a sheet of grain-oriented electromagnetic steel with an improved watt loss property, as well as to the grain oriented electromagnetic steel sheet produced by such method.

There are two kinds of the grain-oriented electromagnetic steel sheets. However, only one kind is industrially produced for employment as the core material of transformers and various electric devices, and that kind is crystallographically designated as having a (110) [001] structure. This designation indicates that the (110) plane of the crystal grains of the steel sheet is parallel to the sheet surface, while the [001] direction of easy magnetization is parallel to the rolling direction of the steel sheet. In the actual steel sheets, the (110) plane of the crystal grains is deviated from the sheet surface, although at only a slight angle, and the [001] direction of the crystal grains is also deviated from the rolling direction at a slight angle. Since the excitation property and watt loss of the electromagnetic steel sheets are largely influenced by the degree of deviations mentioned above, a considerable amount of effort has been put into approximating the crystallographic orientation of all the crystal grains in the ideal (110) [001] orientation. As a result, it is currently possible to industrially produce electromagnetic steel sheets with a low watt loss of W17/50, which is equal to approximately 1.03 W/Kg with regard to a 0.30 mm thick sheet. The designation W17/50 indicates the watt loss under a condition of 1.7T of magnetic flux density and a frequency of 50 Hz.

Successive studies of electromagnetic steel sheet clarified that a prominent decrease of watt loss to a value lower than the value mentioned above cannot be achieved exclusively by means of approximating the crystal grains in the ideal orientation. Generally speaking, watt loss is dependent upon not only the excitation property, but also the crystal grain size of electromagnetic steel sheets. An excessive growth of crystal grains has been usually experienced in the prior efforts to improve the excitation property, and this has a tendency to counterbalance the amount of reduction in watt loss due to the improvement of excitation property. In short, it is not easy to achieve a prominent reduction in watt loss by conventional metallurgical means. Unless means different from metallurgical means for improving the watt loss is provided, the watt loss cannot be improved to a value lower than the conventional level.

It is known from U.S. Pat. No. 3,856,568 that one of the non metallurgical means for improving watt loss is to apply a tensile force to the steel sheets. As a means of applying tensile force, an insulating film is formed on the steel sheets. However, since the tensile force applied by means of the insulating film is limited, the watt loss value can be reduced to only about 1.03 W/Kg as a minimum, even by the aid of the tensile force effects.

Another non metallurgical means is known from U.S. Pat. No. 3,647,575. According to this patent, sharp scratches are formed on the surface of steel sheets by a knife, a blade of a razor, powder emery, a metal brush or the like. The watt loss reduction of a single sheet by the scratches can in fact be expected. However, since this process relies on a mechanical means, rising edges of unevenness are inevitably created on the sheet surface. Because of the intense unevenness as mentioned above not only is the space factor of the laminated sheets greatly decreased but also, the magnetostriction of the sheets is greatly increased. In addition to such disadvantages, there may arise such a serious disadvantage that a predetermined level of watt loss cannot be achieved with regard to the laminated sheets. In other words, the Epstein measurement value of the laminated sheets can be higher than a value measured by SST (measuring device for a single sheet). The reason for the watt loss reduction of the laminated sheets is understood to reside in the fact that the sheet thickness is locally reduced at the identations of the scratches in the steel sheets, and hence, a part of the magnetic flux emanates from each of the steel sheets via the indentations into adjacent, upper and lower sheets. As a result, the watt loss deteriorates due to the thus generated magnetization component, which is perpendicular to the steel sheets. The method of mechanically forming the scratches on the surface of the steel sheets is not advisable when the sheets form a core of laminated steel sheets, for the reasons explained above and, therefore, is difficult to adopt practically.

As still another non metallurgical means, a method for mechanically applying minute strain on the surface of steel sheets is used to improve the watt loss. As is well known, the watt loss is divided into a hysteresis loss and an eddy current loss, which is further divided into a classical eddy current loss and anomalous loss. The classical eddy current loss is caused by an eddy current induced due to a constantly changing magnetization in a magnetic material and results in a loss of the magnetization as a heat. The anomalous loss is caused by the movement of the magnetic walls and is proportional to the square of the moving speed of the magnetic wall. Since such moving speed is proportional to the moving distance of the magnetic walls when the frequency of the external current is constant, the speed and, thus, the anomalous loss are increased with the increase in the width of magnetic domains. However, with the increase in the width of magnetic domains and, thus, the decrease in the number of magnetic walls, the anomalous loss is not proportional to the square of the width of the magnetic domains, but is approximately proportional to the width of the magnetic walls. The anomalous loss accounts for approximately 50% of the watt loss at a commercial frequency of 50 or 60 Hz, and the proportion of anomalous loss is increased due to the recent development of decreasing eddy current and hysteresis losses of grain oriented electromagnetic sheets. Since narrow magnetic domains are important for the decrease of the anomalous loss, a tension force is applied to the sheets, from which the surface film is removed, so as to decrease the width of the magnetic domains.

The prior art includes U.S. Pat. No. 3,990,923, which proposes to insert between the conventional, decarburization and final annealing steps an additional step of locally working the steel sheet, so as to alternately arrange on the sheet surface the worked and non worked regions. The additional working step may be carried out by local plastic working or a local heat treatment by radiation utilizing infrared rays, light rays, electron beams or laser beams. The regions worked by plastic working or heat treatment serve to inhibit the secondary recrystallization of the steel sheet during the final high temperature annealing. In the worked regions the secondary recrystallization starts at a temperature lower than in the non worked regions and, thus, the worked regions function to inhibit the growth of secondary recrystallization grains produced in the non worked regions.

SUMMARY OF THE INVENTION

It is an object of the present invention to decrease the watt loss of a sheet of grain-oriented electromagnetic steel, by using a new step, quite different from mechanical means used after final annealing a and local working, which includes plastic deformation or heat treatment performed prior to the final annealing.

It is another object of the present invention to provide a novel means for decreasing the width of magnetic domains, which influences the anomalous loss, i.e. one factor of the watt loss.

It is a further object of the present invention to provide a process for producing, by a rather simple means, a grain-oriented electromagnetic steel sheet having a low watt loss.

It is still another object of the present invention to provide a grain-oriented electromagnetic steel sheet in which the magnetic domains are subdivided by a novel means.

The above-mentioned objects and other objects according to the present invention can be achieved by producing a sheet of grain-oriented electromagnetic steel by subjecting a steel sheet containing silicon to one or more operations of cold rolling and, if necessary, one or more operations of annealing, and also, to a step of subjecting to decarburization and final high-temperature annealing said sheet which is so cold-rolled and annealed into the thickness of a commercial standard, wherein the applicants' improvement involves the additional step of momentarily irradiating, by a laser beam, the surface of the grain-oriented electromagnetic sheet, which has been subjected to final high temperature annealing, in a crossing direction or directions to a rolling direction, thereby subdividing magnetic domains in the steel sheet and, thus, improving the watt loss of the grain-oriented electromagnetic steel sheet.

BRIEF DESCRIPTION OF THE DRAWINGS

The present invention is explained in detail with reference to the following drawings.

DESCRIPTION OF THE PREFERRED EMBODIMENTS

Figure 1:
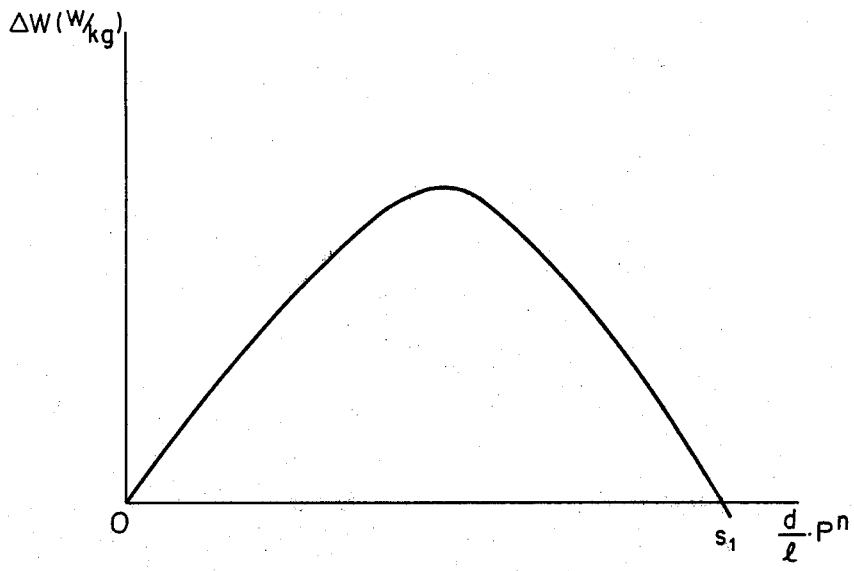
FIG. 1 is a graph illustrating a theoretical value of the watt loss reduction (ΔW).

The starting material of the grain-oriented electromagnetic sheet is a steel produced by such a known steel-making process as steel produced using a converter, an electric furnace or the like, which, is fabricated into a slab, and, further, hot-rolled into a hot-rolled coil. The hot-rolled steel sheet contains less than 4.5% of silicon and, if necessary, acid-soluble aluminum (Sol. Al) in an amount of 0.010 to 0.050% and sulfur in the amount of 0.010 to 0.035%, but there is no restriction about the composition except for the amount of silicon. The hot-rolled coil is subjected to a combination of one or more operations of cold rolling and, if necessary, one or more operations of intermediate annealing, so as to make the thickness of a commercial standard. The steel sheet which is so worked is subjected to decarburizing annealing in wet hydrogen atmosphere and, then, to final high-temperature annealing at more than 1100° C. for more than 10 hours. Thus, a grain-oriented electromagnetic steel sheet is produced. As a result of the final annealing, a secondary recrystallization takes place and the steel sheet is provided with a so-called (110) [001] structure and coarse grains.

The present invention is characterized by irradiating with a laser beam, the surface of the steel sheet, which has been finally annealed, so that regions having a high density of dislocations are locally formed, with the result that minute plastic strain is applied to the steel sheet without any change in the shape of the sheet surface.

According to one of the irradiation methods according to the present invention, the laser irradiation is carried out in such a manner that a pulse laser beam having a width in the range of, for example, from approximately 0.1 to 1 mm, especially approximately 0.2 to 1 mm, is irradiated in a direction or directions almost perpendicular to the rolling direction. The time period for the momentary irradiation does not exceed approximately 10 ms (milliseconds), and should range from 1 ns (nanosecond) to 10 ms (millisecond). The distance between the adjacent irradiated zones ranges from 2.5 to 30 mm. The method described above should satisfy the irradiation condition, which falls within the range of the equation:

$$0.005 \leqq \frac{d}{l} \cdot p^2 \leqq 1.0,$$

which will be explained hereinbelow.

The following is explanation of the principle of the present invention.

The laser beam, which is used to irradiate the surface of the steel sheet, has an energy density which is expressed by P. The laser beam is absorbed by the steel sheet in a ratio of $\alpha$ which ranges from 0 to 1.

The compression stress $p_c$ generated in the steel sheet by the laser beam is expressed by:

$$p_c \propto \alpha' P \quad (1)$$

The density of dislocations $\rho$ formed in the steel sheet is:

$$\rho^{1/n} \propto p_c \quad (2),$$

wherein n is a constant.

The relationship between the energy density P and the dislocation density is therefore:

$$\alpha' p \propto \rho^{1/n} \quad (3),$$

The principle of the present invention is developed from a novel concept that nuclei of new magnetic walls are generated in the regions of high dislocation density and these new magnetic walls subdivide the magnetic domains. The generating probability of these germs or the number of the germs generated per a unit volume of the steel sheet is, therefore, considered to be proportional to the dislocation density $\rho$. Accordingly, the number of nuclei generated per unit length of the steel sheet, which has a predetermined constant thickness, is dependent upon the irradiation width (d) and the irradiation distance (l). Such number (m) means a generating density of nuclei and is expressed by:

$$m \propto \frac{d}{l}\rho, \tag{4}$$

The relationship between the generating density of nuclei (m) and the width (L) of magnetic domains, which are subdivided by the germs, is expressed by the equation:

$$\frac{1}{L} \propto m + \frac{1}{L_0}, \tag{5}$$

wherein $L_0$ indicates the value of L at m=0.

As may be understood from the explanation hereinbefore of the prior art, the watt loss (W) has a positive correlation with the width (L) of magnetic domains. The regions of high dislocation density created by the laser irradiation bring about the disorder or magnetic walls in such regions. The watt loss is, therefore, proportionally increased with the increase in product of the volume (d/l) of the high dislocation regions and the dislocation density ($\rho$).

The watt loss of the steel sheet subjected to the laser irradiation is expressed by:

$$W = C_1L + C_2'\frac{d}{l}\rho, \tag{6}$$

wherein $C_1$ and $C'_2$ are coefficients.

The reduction of watt loss due to the laser irradiation on the steel sheet is:

$$\Delta W = C_1L_0 - \left(C_1L + C_2'\frac{d}{l}\rho\right) = C_1L_0\left(1 - \frac{1}{1 + \alpha L_0\frac{d}{l}P^n}\right) - C_2\frac{d}{l}\cdot P^n \tag{7}$$

wherein $C_1$, $C_2$ and $\alpha$ are constant.

The equation (7), above, is illustrated in FIG. 1, in which the ordinate and abscissa indicate $\Delta W$ and $(d/l)\cdot p^n$, respectively. As is apparent from in FIG. 1, $\Delta W$ is more than zero, namely the watt loss is decreased due to the laser irradiation, when the value of $(d/l)\cdot p^n$ is more than zero and less than $S_1$.

According to the present invention, which is based on the principle explained above, the laser beam is irradiated in such a manner that the irradiation satisfies the condition:

$$0.005 \leqq \frac{d}{l}\cdot P^2 \leqq 1.0, \tag{8}$$

-continued $$\text{preferably, } 0.01 \leqq \frac{d}{l}\cdot P^2 \leqq 0.08, \tag{8'}$$

wherein d is the width of the laser beam in mm, P is the energy density of the laser beam in $J/cm^2$ and l is the irradiation distance in mm.

The laser device which can be used for carrying out the present invention may be any solid or gas laser, provided that the radiation energy is in the range of from 0.1 to 10 $J/cm^2$, and further that the oscillation pulse width is not more than 10 milliseconds. Accordingly, the ruby laser, YAG (Nd-Yittlium-Aluminum-Garnet) laser or nitrogen laser, which are commercially available at present, may be used to carrry out the process of present invention.

When the pulse width and energy exceed the upper limits mentioned above, a thermal melting phenomenon is dominant, at the irradiated regions of the steel sheets, over the increasing effect of dislocation density due to the laser beam irradiation. As a result of the melting phenomenon, a change of crystal structure is induced at the irradiated regions, and hence, almost no improvement in the watt loss can be expected.

Figure 2:
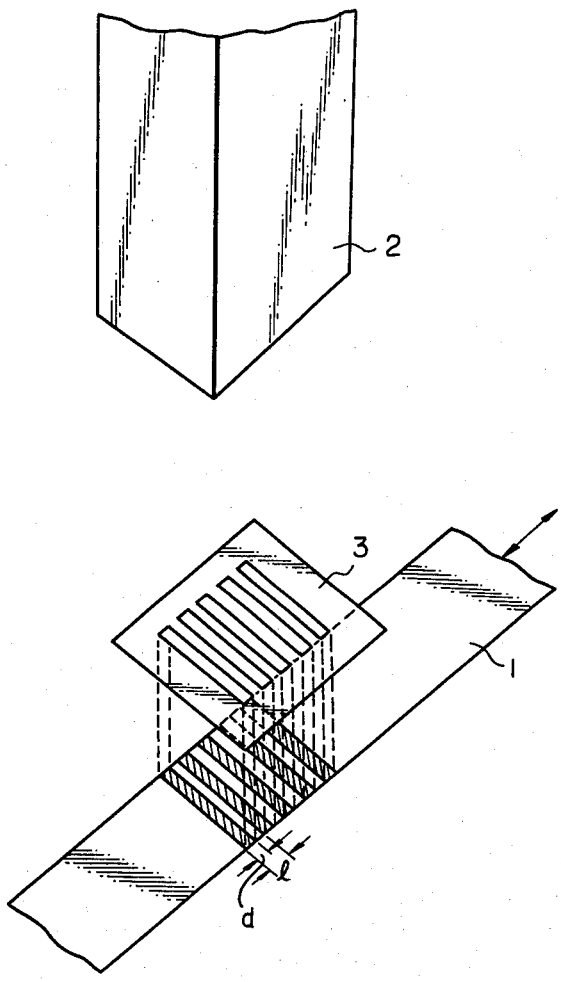
FIG. 2 schematically illustrates an embodiment of the process according to the present invention.

The electromagnetic steel sheet 1 may be irradiated by using the laser beam as shown in FIG. 2. The shielding plate 3 with slits is interposed between the pulse laser ray apparatus 2 and the electromagnetic steel sheet. The laser beam is directed from the apparatus 2 in the direction perpendicular to the sheet surface, as an irradiation pattern extending at a right angle to the rolling direction shown by the double arrow. The irradiated regions shown by hatching have a width (d) and a distance (l).

Figure 3:
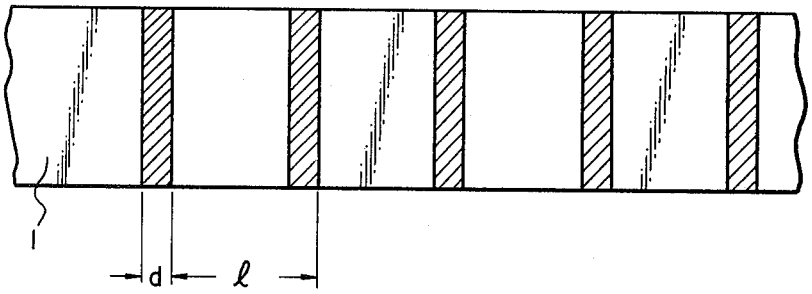
FIG. 3 illustrates an irradiation pattern of a laser beam according to an embodiment of the process of the present invention.

As will be apparent from FIG. 3, the term "irradiation distance" (l) used herein indicates the distance between the end of one irradiated region and the end of an adjacent irradiated region, the latter end being on the same side as the former end.

Figure 4:
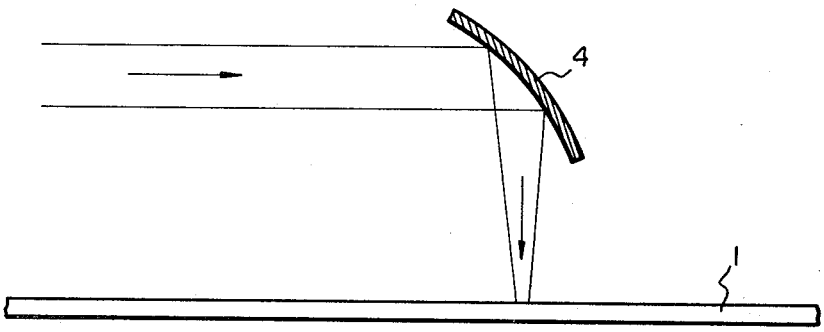
FIG. 4 schematically illustrates another embodiment of the process according to the present invention.

The laser beam may be irradiated by using a reflection mirror system 4, as shown in FIG. 4. The laser beam is condensed by the reflection mirror system 4 and, then, is irradiated onto the steel sheet 1 in the form of a strip. A number of the irradiated regions having the same or different distances therebetween are formed by repeating the irradiation procedure mentioned above.

Figure 5:
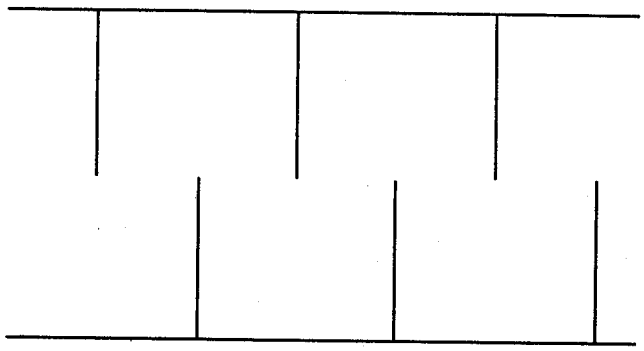
FIGS. 5 and 6 illustrate other irradiation patterns of a laser beam.
Figure 6:
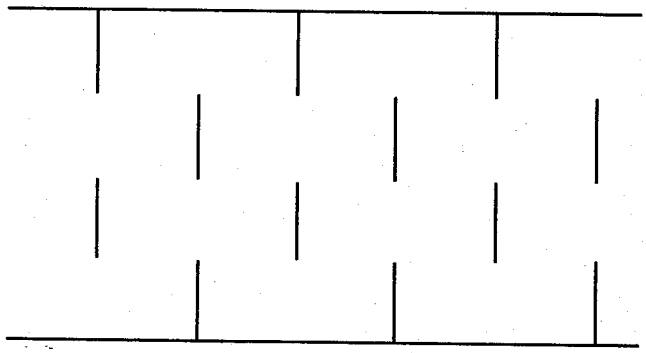

A lens and the like may be used instead of the mirror system 4. Furthermore, instead of arranging the irradiated regions over the entire width of the steel sheet as continuous straight lines, the laser beam may be alternately irradiated in a pattern of a discontinuous zigzag form as seen in FIGS. 5 and 6.

In the irradiation procedure explained above, the laser beam is irradiated in such a manner that is crosses the rolling direction at vertical angle. A vertical crossing angle is preferable, but the crossing angle may not be an exact vertical angle and be deviated therefrom by an angle of 30° at the maximum.

Figure 8B:
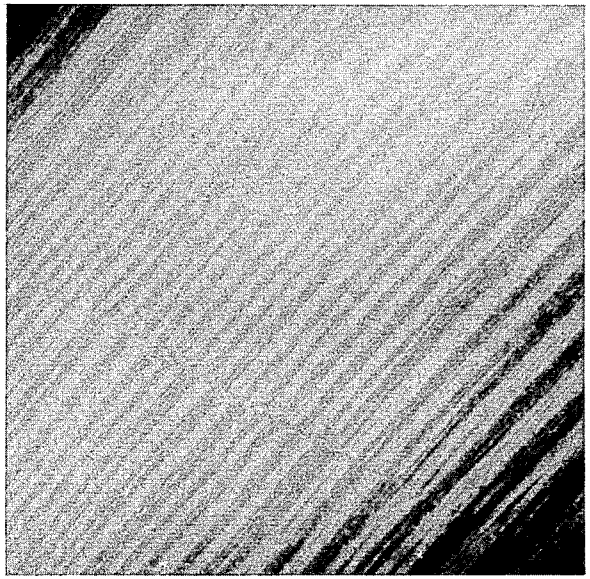
FIGS. 8A and 8B are photographs by a scanning type electron microscope indicating a subdivision of magnetic domains by means of the laser beam irradiation.
Figure 8A:
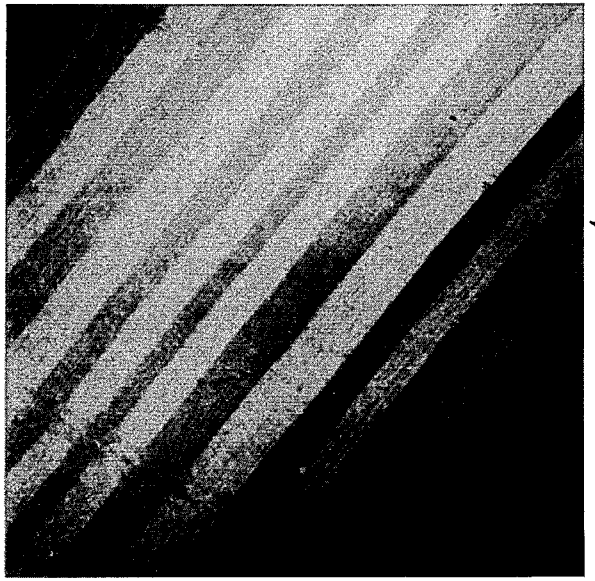

In any of the irradiation methods illustrated in FIGS. 2 through 6, minute strains are generated on the surface of steel sheet, with the result that magnetic domains are subdivided. Referring to FIGS. 8A and 8B, the grain-oriented electromagnetic steel sheet is rolled in the direction denoted by the double arrow a, finally annealed and irradiated by a laser beam in the direction and location shown by the arrows b. As a result of the laser irradiation, micro strains are generated on the regions shown by the arrows b and the widths of magnetic domains at both sides of these regions are subdivided due to the minute strains. It should be noted that the magnetic domains are subdivided in a direction perpendicular to the irradiation direction of the laser beam. As will be apparent from a comparison of FIGS. 8A and 8B, the magnetic domain subdivision effect is more outstanding in FIG. 8B than in FIG. 8A.

The laser beam irradiation according to the present invention is effective for the subdivision of the magnetic domains irrespective of the surface quality of the steel sheet. Namely, the surface of the steel sheet may be a rolled or polished, mirror surface and may be covered by a known insulating film. The steel sheet may, therefore, be irradiated after the application of the insulating film. The laser beam can advantageously be irradiated after the covering of the steel sheet with the insulating film so as to generate minute strains in the sheet, without destroying the insulating film completely. The process according to the present invention is more effective for reducing the watt loss than the conventional, marking-off process or scratching process, in which processes the indentations are formed on the insulating film, which is destroyed due to the scratching and the like.

The reduction of watt loss due to the irradiation of the laser beam under the various conditions is illustrated in Table 1. From Table 1, the irradiation conditions for effectively reducing the watt loss will be apparent.

TABLE 1

| Irradiation Width (mm) | Irradiation Energy (J/cm²) 0.5 ~ 1.4 Irradiation Distance (mm) 2.5 | 5 | 10 | 20 | 30 | 1.5 ~ 2.5 Irradiation Distance (mm) 2.5 | 5 | 10 | 20 | 30 |
|---|---|---|---|---|---|---|---|---|---|---|
| 0.1 | | Δ | x | | | | | | | |
| 0.25 | O | Δ | x | | | ◎ | O | O | Δ | |
| 0.5 | O | Δ | Δ | Δ | x | O | O | ◎ | O | Δ |
| 1.0 | x | O | O | Δ | Δ | xx | Δ | O | | |
| 2.0 | | x | | | | | xx | | | |

Remarks:
xx $\Delta W \leqq 0$
x $0 < \Delta W \leqq 0.03$
Δ $0.03 < \Delta W \leqq 0.06$
O $0.06 < \Delta W \leqq 0.09$
◎ $0.09 < \Delta W$ As will be apparent from Table 1, above, the watt loss can be reduced by selecting the irradiation conditions so that they are within the ranges of: an irradiation energy or energy density (P) of from 0.5 to 2.5 J/cm²; an irradiation distance (l) of from 2.5 to 30 mm, and; an irradiation width (d) of from 0.1 to 2.0 mm.

Figure 7:
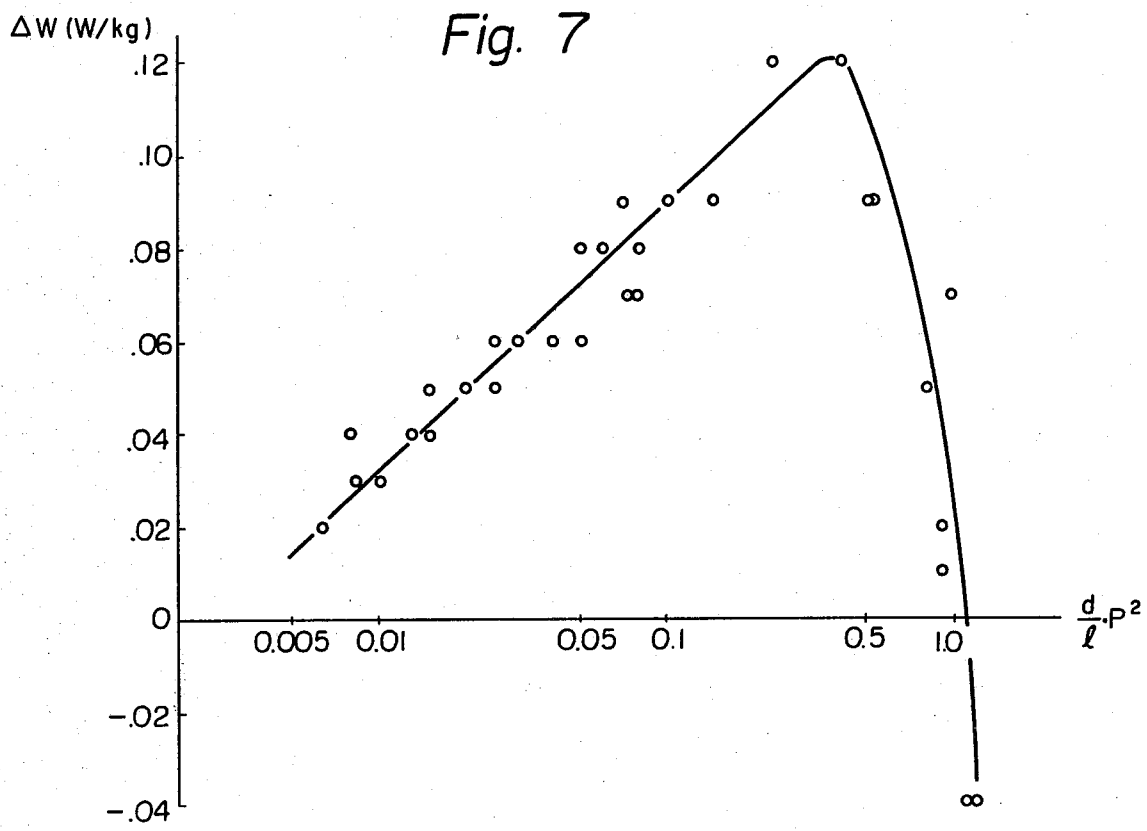
FIG. 7 is a graph illustrating an example of the watt loss reduction (ΔW).

The results of the watt loss reduction (ΔW) as shown in Table 1 are illustrated in a graph in FIG. 7, wherein the abscissa and ordinate indicate $(d/l)\cdot P^2$ and the reduction of watt loss (ΔW), respectively. The watt loss is appreciably reduced at the value of $\Delta W = 0.02$ W/Kg. The value of $(d/l)\cdot p^2$ corresponding to an ΔW of 0.02 W/Kg is 0.005 $J^2/cm^4$ at the minimum and 1.0 $J^2/cm^4$ at the maximum.

In order to improve the quality of the grain-oriented electromagnetic steel sheet more than one grade, it is necessary to increase the ΔW value to 0.04 or more by carrying out the laser beam irradiation under the condition that the value of $(d/l)\cdot P^2$ ranges from 0.01 to 0.8. The watt loss reduction (ΔW) is further increased to 0.08 or more and, therefore, the watt loss property can be remarkably enhanced, by adjusting the value of $(d/l)\cdot P^2$ to within the range of from 0.08 to 0.60. The watt loss reduction (ΔW) is furthermore increased to 0.10 or more by adjusting the value of $(d/l)\cdot P^2$ so that it is within the range of from 0.20 to 0.40.

It is possible to reliably produce by the conventional methods a grain-oriented electromagnetic steel sheet having a watt loss in the range of from 1.05 to 1.14 W/Kg. The watt loss of the electromagnetic steel sheet may be from 0.95 to 1.12 W/Kg. Such watt loss can be reduced by irradiating with a laser beam used according to the present invention, to a value of from 1.03 to 1.12, at a $(d/l)\cdot P^2$ of from 0.01 to 0.8, preferably to a value of from 0.97 to 1.06, at $(d/l)\cdot P^2$ of from 0.08 to 0.60, and more prefereably, to a value of from 0.95 to 1.04 W/Kg, at $(d/l)\cdot P^2$ of 0.2 to 0.4. A considerably low watt loss in the range of 0.95 to 1.00 can be achieved by adjusting the value of $(d/l)\cdot P^2$ to approximately from 0.4 to 0.5.

The present invention will hereinafter be explained by way of Examples.

EXAMPLE 1

A 1100 mm wide sheet of hot-rolled steel containing 0.051% of carbon, 2.92% of silicon, 0.026% of sulfur and 0.027% of acid soluble aluminum, was subjected to annealing at 1120° C. for 2 minutes, cold-rolled to a thickness of 0.30 mm, and decarburized at 850° C. in a wet hydrogen atmosphere for 4 minutes. The sheet was finally subjected to a high temperature annealing at 1200° C. for 20 hours. As a result of the process mentioned above, the thus obtained (110) [001] grain-oriented electromagnetic steel sheet exhibited a magnetic flux density $B_8$ of 1.935 T and a watt loss value W/17/50 of 1.10 W/Kg.

Using a commercially available pulse laser having a pulse width of approximately 30 ns, the steel sheet was subsequently irradiated by the laser beam in the perpendicular direction of the rolling direction under the conditions of:

an energy density of the pulse laser beam (P) of 0.8 J/cm²;

an irradiation distance (l) of 10 mm;

an irradiation width (d) of 0.1 mm, and;

$a(d/l)\cdot P^2$ of 0.0064.

The irradiation width (d) was established by the aid of the slits in the shielding plate 3 illustrated in FIG. 2.

The magnetic flux density $B_8$ and the watt loss value W17/50 after the irradiation were 1.934 T and 1.08 W/Kg, respectively. Accordingly, the watt loss reduction (ΔW) was 0.02 W/Kg, which is the lowest appreciable reduction.

EXAMPLE 2

A 1100 mm wide sheet of hot-rolled steel containing 0.048% of carbon, 2.90% of silicon, 0.025% of sulfur and 0.028% of acid soluble aluminum, was subjected to annealing at 1120° C. for 2 minutes, cold rolled to a thickness of 0.30 mm, and decarburized at 850° C. in a wet hydrogen atmosphere for 4 minutes. The sheet was finally subjected to a high temperature annealing at 1200° C. for 20 hours. As a result of the process mentioned above, the thus obtained (110) [001] grain-oriented electromagnetic steel sheet exhibited a magnetic flux density of 1.954 T and a watt loss value W17/50 of 1.06 W/Kg.

The steel sheet thereafter was irradiated by the laser beam, by scanning the laser beam in a direction perpendicular to the rolling direction under the conditions of:

an energy density of pulse laser beam (P) of 2.0 J/cm²;

an irradiation distance (l) of 2.5 mm;

an irradiation width (d) of 0.25 mm, and;
a $(d/l)\cdot P^2$ of 0.4.

The magnetic flux density $B_8$ and the watt loss value W17/50 after the irradiation were 1.952 T and 0.96 W/Kg, respectively. Accordingly, the watt loss reduction ($\Delta W$) was 0.12 W/Kg, which value is sufficient for enhancing the quality of an electromagnetic steel sheet one or more grades.

EXAMPLE 3

A 1100 mm wide sheet of hot-rolled steel containing 0.045% of carbon, 2.90% of silicon, 0.025% of sulfur and 0.027% of acid soluble aluminum, was subjected to annealing at 1120° C. for 2 minutes, cold rolled to a thickness of 0.30 mm, and decarburized at 850° C. in a wet hydrogen atmosphere for 4 minutes. The sheet was subjected to a final high temperature annealing at 1200° C. for 20 hours. Finally, a conventional insulating film was deposited on the steel sheet. As a result of the process mentioned above, the thus obtained (110) [001] grain-oriented electromagnetic steel sheet exhibited a magnetic flux density of 1.927 T and a watt loss value W17/50 of 1.05 W/Kg.

The steel sheet was thereafter irradiated by the laser beam, by scanning the laser beam in a direction perpendicular to the rolling direction under the conditions of:
an energy density of pulse laser beam (P) of 2.0 J/cm$^2$;
an irradiation distance (l) of 10 mm;
an irradiation width (d) of 0.1 mm, and;
a $(d/l)\cdot P^2$ of 0.04.

The magnetic flux density $B_8$ and the watt loss value W17/50 after the irradiation were 1.925 T and 1.05 W/Kg, respectively. Accordingly, the watt loss reduction ($\Delta W$) was 0.06 W/Kg.

EXAMPLE 4

A 1100 mm wide sheet of hot-rolled steel containing 0.048% of carbon, 3.00% of silicon, 0.024% of sulfur and 0.026% of acid soluble aluminum, was subjected to annealing at 1120° C. for 2 minutes, cold rolled to a thickness of 0.35 mm, and decarburized at 850° C. in a wet hydrogen atmosphere for 4 minutes. The sheet was finally subjected to a high temperature annealing at 1200° C. for 20 hours. As a result of the process mentioned above, the thus obtained (110) [001] grain-oriented electromagnetic steel sheet exhibited a magnetic flux density $B_8$ of 1.926 T and a watt loss value W17/50 of 1.14 W/Kg.

The steel sheet was irradiated by the laser beam in accord with the present invention, by scanning the laser beam in a direction perpendicular to the rolling direction under the conditions of:
an energy density of pulse laser beam (P) of 1.5 J/cm$^2$;
an irradiation distance (l) of 10 mm;
an irradiation width (d) of 0.25 mm, and;
a $(d/l)\cdot P^2$ of 0.056.

The magnetic flux density $B_8$ and the watt loss value W17/50 after the irradiation were 1.926 T and 1.06 W/Kg, respectively. Accordingly, the watt loss reduction ($\Delta W$) was 0.08 W/Kg.

EXAMPLE 5 (CONTROL)

A 1100 mm wide sheet containing of hot-rolled steel 0.045% of carbon, 2.90% of silicon, 0.025% of sulfur and 0.026% of acid soluble aluminum, was subjected to annealing at 1120° C. for 2 minutes, cold rolled to a thickness of 0.30 mm, and decarburized at 850° C. in a wet hydrogen atmosphere for 4 minutes. The sheet was finally subjected to a high temperature annealing at 1200° C. for 20 hours. As a result of the process mentioned above, the thus obtained (110) [001] grain-oriented electromagnetic steel sheet exhibited a magnetic flux density $B_8$ of 1.943 T and a watt loss value W17/50 of 1.02 W/Kg.

The steel sheet was thereafter irradiated by the laser beam, by scanning the laser beam in a direction perpendicular to the rolling direction under the conditions of:
an energy density of pulse laser beam (P) of 1.7 J/cm$^2$;
an irradiation distance (l) of 5 mm;
an irradiation width (d) of 2 mm, and;
a $(d/l)\cdot P^2$ of 1.16.

The magnetic flux density $B_8$ and the watt loss value W17/50 after the irradiation were 1.942 T and 1.06 W/Kg, respectively. Accordingly, the watt loss reduction ($\Delta W$) was increased in an amount 0.04 W/Kg, due to the irradiation.

What we claim is:

1. In a method of producing a grain-oriented silicon-steel electrical sheet by cold rolling a silicon-steel sheet, with intermediate annealing if necessary, to a standard electrical sheet thickness, decarbonizing the sheet if necessary, and subjecting the sheet to a final high-temperature anneal, so as to produce a grain-oriented silicon-steel electrical sheet having a plurality of magnetic domains; wherein the improvement comprises momentarily irradiating the finally annealed sheet by a laser beam so as to subdivide said domains to an extent appreciably improving the watt loss of the finally annealed sheet as compared to the watt loss it had prior to said irradiating.

2. A method according to claim 1, wherein said laser beam is irradiated in such a manner that the irradiation satisfies the condition:

$$0.005 \leqq \frac{d}{l} \cdot P^2 \leqq 1.0 \qquad (8)$$

wherein d is the width of the laser beam in mm, P is the energy density of the laser beam in J/cm$^2$ and l is the irradiation distance in mm.

3. A method according to claim 2, wherein said irradiation condition is:

$$0.01 \leqq \frac{d}{l} \cdot P^2 \leqq 0.8$$

4. A method according to claim 3, wherein said irradiation condition is:

$$0.08 \leqq \frac{d}{l} \cdot P^2 \leqq 0.60.$$

5. A method according to claim 4, wherein said irradiation condition is:

$$0.20 \leqq \frac{d}{l} \cdot P^2 \leqq 0.40.$$

6. A method according to claim 1, wherein, the irradiation time of said laser beam is from 1 nanosecond to 10 milliseconds.

7. A method according to claim 1, wherein the irradiation energy of said laser beam is in the range of from 0.5 to 2.5 $J/cm^2$.

8. A method according to claim 1, wherein said laser beam is irradiated onto the steel sheet, on which an insulating film has been applied.

9. A method according to claim 1, wherein the direction of laser beam irradiation crosses the rolling direction of said steel sheet and its direction of grain orientation, at an angle of from 30° to 90°.

10. The method of claims 2, 3, 4, 5, 6, 7, 8, or 1 in which said laser beam is caused to traverse the sheet at an angle across its grain orientation.

11. A method for improving the watt loss of a silicon-steel electrical sheet of the grain-oriented type produced by a process comprising cold-rolling the sheet completely to a commercial standard electrical sheet thickness and a final high-temperature anneal so as to provide the sheet with a substantially (110) [001] structure having a plurality of magnetic domains; said method comprising irradiating said sheet with laser beam energy so as to subdivide said magnetic domains to a degree improving the watt loss of the sheet without any change in the shape of the sheet surface.

12. The method of claim 11 in which said irradiating is done is a series of interspaced substantially parallel zones of the sheet's surface.

13. The method of claim 12 in which said zones are oriented across the grain-orientation of the sheet.

14. The method of claim 13 in which said irradiating is via a pulsed laser beam having a time period of from 1 NS to 10 ms and a width of from about 0.1 to 1.0 mm, and so that the interspacing distance between adjacent zones ranges from 2.5 to 30 mm.

15. The method of claim 14 in which said zones are substantially perpendicular to the sheet's grain orientation.

* * * * *

UNITED STATES PATENT AND TRADEMARK OFFICE

CERTIFICATE OF CORRECTION

PATENT NO. : 4,293,350

DATED : October 6, 1981

INVENTOR(S) : Ichiyama et al.

It is certified that error appears in the above—identified patent and that said Letters Patent is hereby corrected as shown below:

Col. 2, line 14 change "identations" to --indentations--

Col. 3, line 12 after "annealing" change "a" to --,--

Col. 5, line 31 after "disorder" change "or" to --of--

Col. 5, line 35 after "volume" change "(d/I)" to --(d/l--

Col. 5, equation (6)

change "$C_2$'" to --$C'_2$--

UNITED STATES PATENT AND TRADEMARK OFFICE

CERTIFICATE OF CORRECTION

PATENT NO. : 4,293,350

DATED : October 6, 1981

INVENTOR(S) : Ichiyama et al.

It is certified that error appears in the above—identified patent and that said Letters Patent is hereby corrected as shown below:

Col. 5, equation (7) Part I change "$C_2$'" to --$C'_2$"

Col. 5, line 58 change "(d/I)" to --(d/l)--

Col. 5, line 60 change "(d/I)" to --(d/l)--

Col. 6, line 6 after "and" change "I" to --l--

Col. 6, line 34 change "(I)" to --(l)--

UNITED STATES PATENT AND TRADEMARK OFFICE

CERTIFICATE OF CORRECTION

PATENT NO. : 4,293,350

DATED : October 6, 1981

INVENTOR(S) : Ichiyama et al.

It is certified that error appears in the above—identified patent and that said Letters Patent is hereby corrected as shown below:

Col. 6, line 36 change "(I)" to --(1)--

Col. 7, line 35 after "Δ χ" insert under --5 10--
0 Δ

Col. 7, line 49 after "distance" change "(I)" to --(1)--

Col. 7, line 53 change "(d/I)" to --(d/1)--

Col. 7, line 56 change "(d/I)" to --(d/1)-- also change "$p^2$" to --$P^2$--

UNITED STATES PATENT AND TRADEMARK OFFICE

CERTIFICATE OF CORRECTION

PATENT NO. : 4,293,350

DATED : October 6, 1981

INVENTOR(S) : Ichiyama et al.

It is certified that error appears in the above—identified patent and that said Letters Patent is hereby corrected as shown below:

Col. 7, line 63 change "(d/I)" to --(d/l)--

Col. 7, line 67 change "(d/I)" to --(d/l)--

Col. 8, line 1 change "(d/I)" to --(d/l)--

Col. 8, line 10 change "(d/I)" to --(d/l)--

Col. 8, line 11 change "(d/I)" to --(d/l)--

Col. 8, line 13 change "(d/I)" to --(d/l)--

UNITED STATES PATENT AND TRADEMARK OFFICE

CERTIFICATE OF CORRECTION

PATENT NO. : 4,293,350

DATED : October 6, 1981

INVENTOR(S) : Ichiyama et al.

It is certified that error appears in the above—identified patent and that said Letters Patent is hereby corrected as shown below:

Col. 8, line 15 change "(d/I)" to --(d/l)--

Col. 8, line 41 change "(d/I)" to --(d/l)--

Col. 8, line 31 change "W/17/50" to --Wl7/50--

Col. 8, line 39 after "distance" change "(I)" to --(l)--

Col. 8, line 63 after "sheet" change "thereafter was" to --was thereafter--

UNITED STATES PATENT AND TRADEMARK OFFICE

CERTIFICATE OF CORRECTION

PATENT NO. : 4,293,350

DATED : October 6, 1981

INVENTOR(S) : Ichiyama et al.

It is certified that error appears in the above—identified patent and that said Letters Patent is hereby corrected as shown below:

Col. 8, line 68 change "(I)" to --(l)--

Col. 9, line 2 change "(d/I)" to --(d/l)--

Col. 9, line 29 change "(I)" to --(l)--

Col. 9, line 31 change "(d/I)" to --(d/l)--

Col. 9, line 58 change "(d/I)" to --(d/l)--

Col. 9, line 56 change "(I)" to --(l)--

UNITED STATES PATENT AND TRADEMARK OFFICE

CERTIFICATE OF CORRECTION

PATENT NO. : 4,293,350

DATED : October 6, 1981

INVENTOR(S) : Ichiyama et al.

It is certified that error appears in the above—identified patent and that said Letters Patent is hereby corrected as shown below:

Col. 9, line 65 after "sheet" change "containing of hot-rolled steel" to --of hot-rolled steel containing--

Col. 10, line 14 change "(I)" to --(1)--

Col. 10, line 16 change "(I)" to --(1)--

Col. 10, line 45 change "(I)" to --(1)--

Signed and Sealed this

*Fourteenth* Day of *December 1982*

[SEAL]

*Attest:*

*Attesting Officer*

GERALD J. MOSSINGHOFF

*Commissioner of Patents and Trademarks*